US005398868A

United States Patent [19]

Densen

[11] Patent Number: 5,398,868

[45] Date of Patent: Mar. 21, 1995

[54] FOLDABLE KNOCK-DOWN STORAGE BOX WITH DETACHABLE HINGEABLE COVER

[76] Inventor: Mark S. Densen, 96 Rotary Dr., Summit, N.J. 07901

[21] Appl. No.: 251,299

[22] Filed: May 31, 1994

[51] Int. Cl.[6] ..... B65D 43/16; B65D 5/68

[52] U.S. Cl. ..... 229/125.08; 229/125.28

[58] Field of Search ..... 229/23 BT, 125.08, 125.19, 229/125.28

[56] References Cited

U.S. PATENT DOCUMENTS

| | | | |
|---|---|---|---|
| 808,766 | 1/1906 | Lehmann | 229/125.08 |
| 1,058,929 | 4/1913 | Weiss | 229/125.08 |
| 1,859,903 | 5/1932 | Wellman | 229/125.08 |
| 1,950,168 | 3/1934 | Fancher | 229/125.08 |
| 2,003,224 | 5/1935 | Schoettle | 229/125.08 |
| 2,037,341 | 4/1936 | Scandore | 229/125.08 |
| 2,465,324 | 3/1949 | De Mian | 229/125.08 |
| 4,169,553 | 10/1979 | Cain . | |
| 4,365,738 | 12/1982 | Densen . | |
| 4,444,354 | 4/1984 | Staelgraeve . | |
| 4,477,015 | 10/1984 | Lozaun | 229/125.08 |
| 4,953,779 | 9/1990 | Densen . | |
| 4,995,557 | 2/1991 | Fremion | 229/23 BT |
| 5,201,461 | 4/1993 | Sykora | 229/125.08 |

FOREIGN PATENT DOCUMENTS

| | | | |
|---|---|---|---|
| 369948 | 5/1990 | European Pat. Off. | 229/125.08 |
| 32913 | 4/1963 | Finland | 229/125.08 |
| 1359284 | 3/1964 | France | 229/125.28 |
| 2239386 | 2/1975 | France . | |
| 95473 | 9/1960 | Netherlands | 229/125.08 |
| 188889 | 4/1964 | Sweden | 229/125.08 |
| 1083059 | 9/1967 | United Kingdom | 229/125.08 |

*Primary Examiner*—Gary E. Elkins
*Attorney, Agent, or Firm*—Fattibene and Fattibene

[57] ABSTRACT

A foldable knock-down storage box having a box body and cover wherein each is formed of a blank of foldable sheet material that can be readily erected to define the box body and cover wherein the cover is detachably hinged to the box body so that the box may be optimally used with either a hinged cover or a separate cover.

2 Claims, 4 Drawing Sheets

FIG. 1
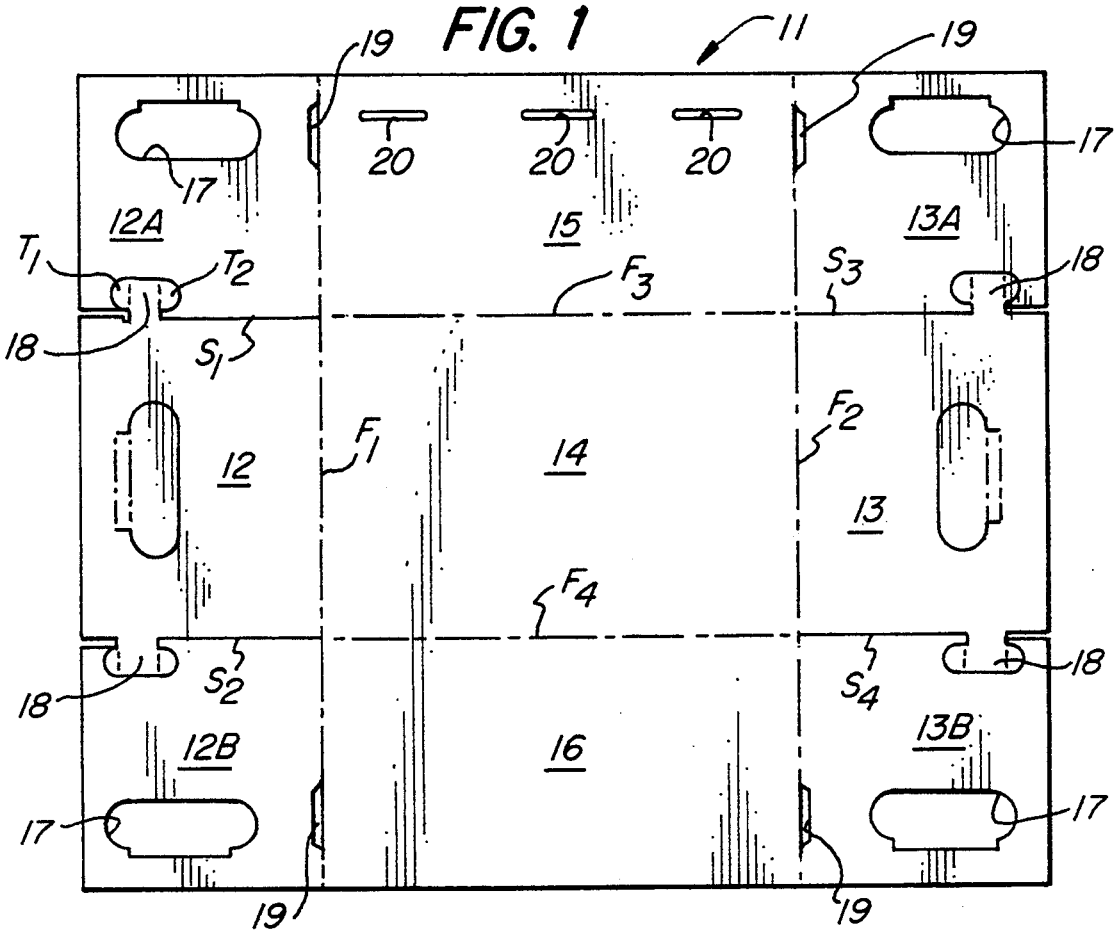
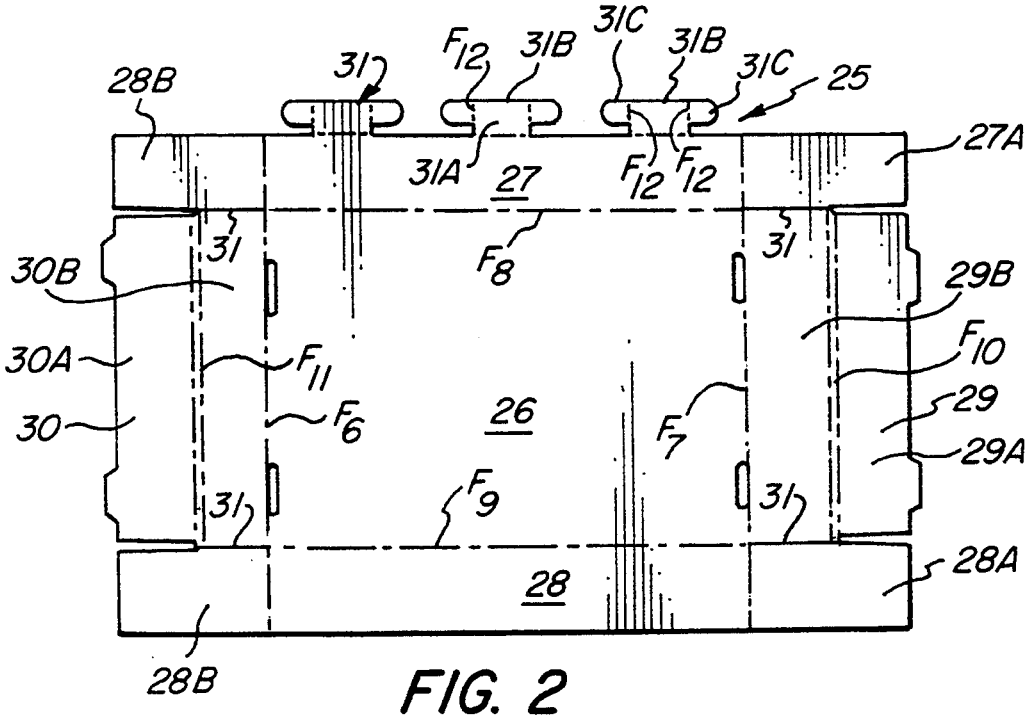
FIG. 2

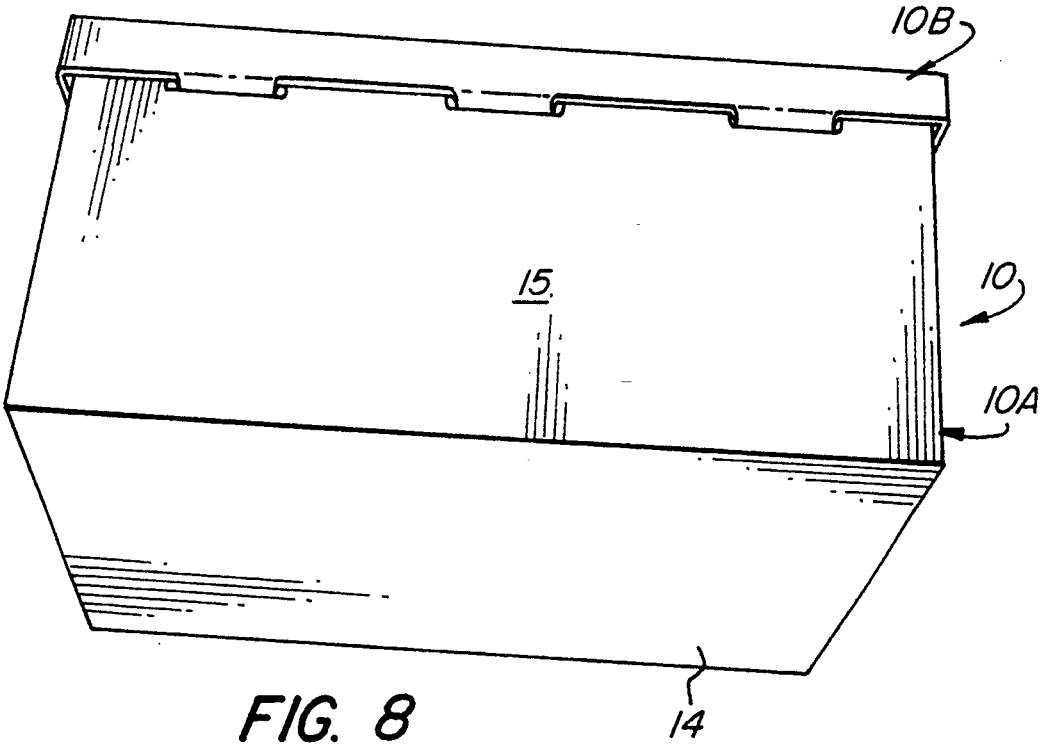
FIG. 8
FIG. 9
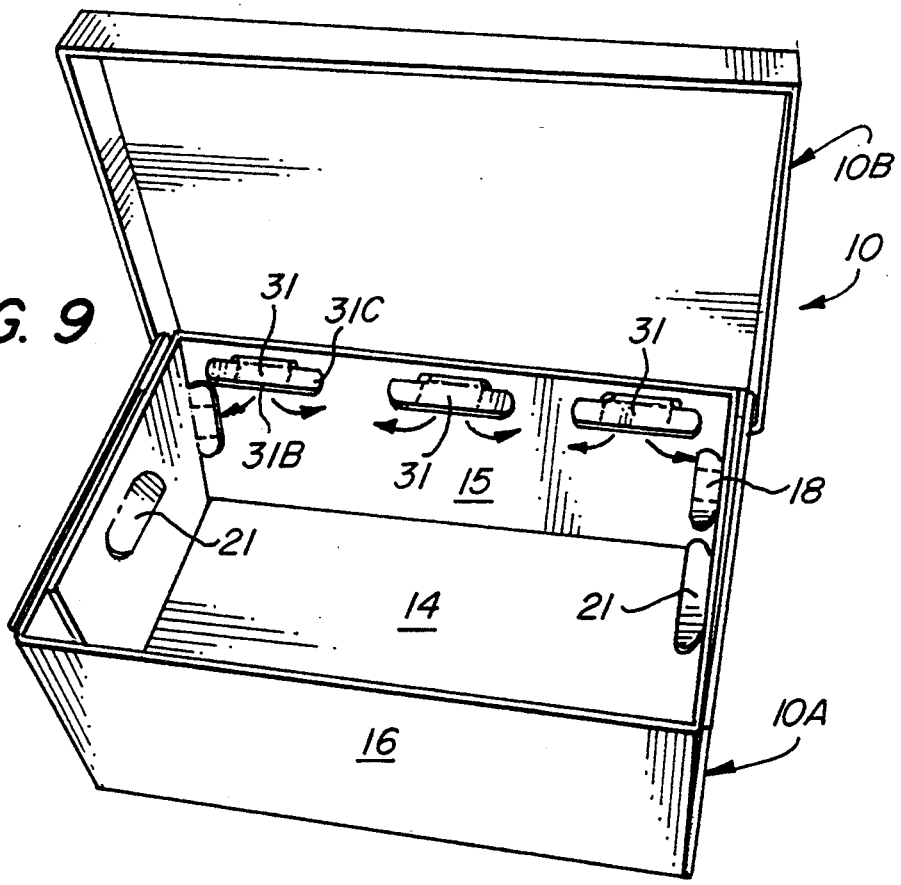

FOLDABLE KNOCK-DOWN STORAGE BOX WITH DETACHABLE HINGEABLE COVER

FIELD OF INVENTION

This invention relates generally to the art of readily knock-down types of foldable container or box formed of blank sheets of pre-cut material having predetermined foldlines about which the blank may be folded to define an erected box and a cover therefor.

RELATED PATENTS

This application is directed to improvements to those types of containers or storage boxes disclosed in my prior U.S. Pat. No. 4,365,378 granted Dec. 28, 1982 for Knock Down Container Package and Method of Making Same, and U.S. Pat. No. 4,953,779 granted Sep. 4, 1990 for Reversible Foldable Container and Closure Therefor.

PROBLEM AND PRIOR ART

As disclosed in my prior U.S. Pat. Nos. 4,365,738 and 4,953,770 and other known patents, e.g. U.S. Pat. Nos. 4,169,553; 4,444,354 and French Patent 2,239,386, erecting a box or container from a blank of sheet material to form a box body and a cover therefor are generally known. As shown or disclosed in these patents, the box and cover therefor are generally formed of two separate and distinct blanks which are pre-formed and folded to define a box body and a cover separate and distinct from the box body. The French Patent 2,239,386 discloses a preformed blank arranged to be folded to form a box body with an integrally formed or connected hinged cover. The known prior art foldable containers therefore have been formed with either separate and detached covers or integrally hinged covers. Each such arrangement had its advantages and disadvantages.

An object of this invention is to provide a storage box or container which is formed and constructed so as to have the advantages of both the boxes or containers having a separate cover and a hingedly connected cover.

Another object of this invention is to provide a box or container construction where the user may have the option of using the box or container with a separate detachable cover or as a box or container having a hingedly connected cover.

Another object of this invention is to provide a box construction in which the cover is detachably hingeable to the body of the box or container.

Another object of this invention is to provide a box construction formed of readily foldable sheet material having interconnecting locking members for detachably hinging the cover to the body portion of the box.

Another object of this invention is to provide for a knock-down box construction of preformed blank sheet material which can be readily folded to form a box body and a separate cover therefor, each having integrally formed complementary interlocking members for hingedly connecting the cover to the box body quickly and easily.

SUMMARY OF THE INVENTION

The foregoing objects and other features of this invention are attained by a box or container construction formed of blank sheet material that can be readily folded to define a box body and a cover therefor. According to this invention, the respective blanks are each formed with members which in the operative position are arranged to be interlocked so as to detachably hinge the cover to the box body so that the cover may swing between an open and closed position. Optionally, the interlocking members may be readily detached so that the cover can be readily separated and used as a detached cover in a conventional manner. This is readily attained by forming on the marginal portion on one of the blanks a foldable T-shaped tab which is adapted to be received in complementary slots formed along the marginal edge of the other blank, so that in the assembled position of the box, the T-shaped tabs are arranged to interlock with the slots of the other blank to form a hinged connection therebetween. The arrangement is such that the cover can be readily attached and detached to the box body, and when attached is hinged to the box body to swing between an open or closed position.

IN THE DRAWINGS

FIG. 1 is a plan view of a preformed blank sheet of material to form a box body.

FIG. 2 is a plan view of a preformed blank of sheet material for forming a box cover.

FIG. 8 is a perspective back outside view of the box body and cover hingedly connected.

FIG. 9 is a perspective inside view of the box with the cover detachably and hingedly connected thereto.

DETAILED DESCRIPTION

Figure 4:
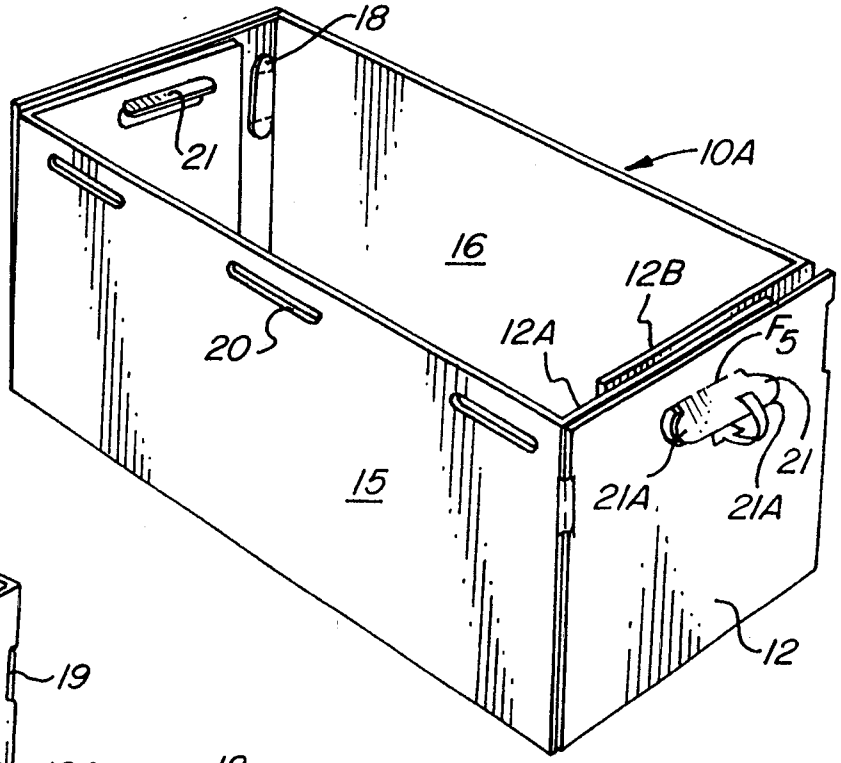
FIG. 4 is a perspective view of the blank of FIG. 1 in its folded position to define the box body.

Referring to FIGS. 1 to 9, there is disclosed therein a container or box construction embodying the present invention. Such containers or boxes 10 are frequently used for temporary or permanent storage of various articles. In accordance with this invention, the box or container is preferably formed of blank sheet material which is generally pre-cut and scored so that the box body member and cover member can be readily assembled from the respective pre-cut and scored blanks.

FIG. 1 illustrates a plan view of a pre-cut and scored blank 11 from which the box body or member 10A is formed. As shown, the blank 11 is formed from a rectangular or square sheet of foldable material, e.g. cardboard or the like, which is cut and scored so as to be readily folded to define the box body 10A. In the illustrated embodiment, the blank 11 is provided with a pair of transversely extending foldlines $F_1$ and $F_2$ extending across the width of the blank 11 to define a central portion and opposed end portions. The end portions include end panels 12 and 13 and their corresponding corner end panels 12A, 12B and 13A, 13B respectively. Extending at spaced intervals between foldlines $F_1$ and $F_2$ are a pair of spaced foldlines $F_3$ and $F_4$ to define the bottom panel 14 of the box body 10A and the opposed side panels 15 and 16. The respective corner panels 12A, 12B and 13A, 13B are separated from their corresponding end panels 12 and 13 by a die cut or slit formed along $S_1$, $S_2$ and $S_3$, $S_4$ respectively. The respective corner end panels 12A, 12B and 13A, 13B are each provided with a blanked out hand hole 17, which in the folded position of the blank 11 are disclosed in alignment at the opposed ends of the assembled box body 10A. Formed on the opposed sides of the end panels 12 and 13 are locking tabs 18 which are blanked out of the plane of the adjacent corner end panels 12A, 12B and 13A, 13B. The respective locking tabs 18 are generally T-shaped, the end of which can be folded about tab foldlines $T_1$ and $T_2$ to facilitate the insertion of the tabs 18 in a complementary locking slot 19 formed adjacent the respective sides 15, 16 along foldlines $F_1$ and $F_2$. The blank 11 is also provided with a plurality of hinge slots 20 located along the upper edge of one of the side panels, e.g. side panel 15 as seen in FIG. 1.

Figure 3:
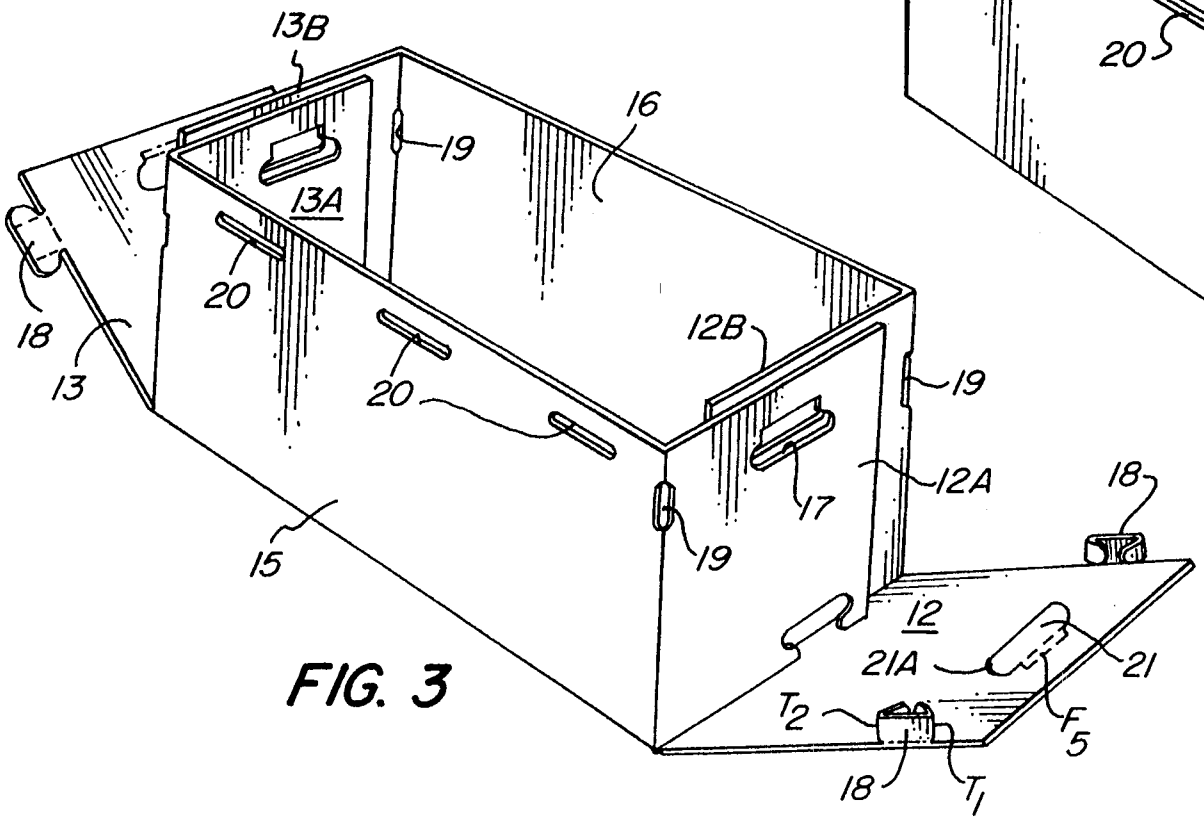
FIG. 3 is a perspective view of the blank of FIG. 1 in a partially folded position to define the box body.

To assemble blank 11 to form the box body 10A, the respective side panels 15 and 16 are folded along foldlines $F_3$, $F_2$ at right angles to the bottom panel 14. The respective corner end panels 12A, 12B and 13A, 13B are then folded toward each other at right angles to their respective connected side panels 15 and 16 as best seen in FIG. 3. In doing so, it will be noted that the hand holes 17 of the respective corner panels 12A, 12B and 13A, 13B are disposed in alignment. The opposed end panels 12 and 13 are then folded about their respective foldlines $F_1$ and $F_2$ to overlap the respective corner end panels to form the box body. The folded panels are maintained in their folded position by engaging the locking tabs 18 in their complementary locking slots 19. It will be noted that the wings or opposed ends of the locking tabs are folded about their foldlines $T_1$, $T_2$ to permit the tabs 18 to be inserted into their complementary slot 19, whereupon the opposed wings or ends of the tab 18 are extended to lock the end panels to the opposed side panels.

The respective end panels 12 and 13 are each provided with a handle flap 21 which is hinged about a foldline $F_5$ to the end panel. In the assembled position, the handle flap 21 is folded to extend through the aligned handle holes 17 and folded to lock the corresponding end panel to the underlying corner end panels. It will be noted that the handle flap 21 is generally T-shaped with the outer ends or wings 21A functioning to lock the end panel and corresponding corner panels together, e.g. end panel 12 to corner panels 12A and 12B, in the assembled position of the box body.

FIG. 2 illustrates a blank 25 from which the cover or member 10B for the box body 10A can be formed. The cover blank 25 is likewise formed of a sheet of foldable material, e.g. cardboard or the like, having a pair of foldlines $F_6$ and $F_7$ extending transversely of the blank 25. Extending at spaced intervals between foldlines $F_6$, $F_7$ are foldlines $F_8$, $F_9$ to define the top panel 26 and connected side edges 27, 28 arranged to be hingedly folded about foldlines $F_8$ and $F_9$ respectively. Connected to the opposed ends of the respective side edges 27, 28 are corner flaps 27A, 27B and 28A, 28B respectively which, in the assembled position, are folded about foldlines $F_6$ and $F_7$. The respective cover flaps 27A, 27B and 28A, 28B are separated from the end forming flaps 29, 39 by a slit or cut 31.

The respective end flaps 29, 30 are each provided with a folding line $F_{10}$, $F_{11}$ extending intermediate the width thereof, about which the outer portion 29A, 30A of the respective end flaps 29, 30 are reversely folded about the inner portion 29B, 30B of the end flaps 29, 30 and about the cover flaps 27A, 27B and 28A, 28B in the erected position of the cover.

Connected along one edge of the blank 25 are a plurality of hinge tabs 31. Three such tabs 31 are illustrated. Each hinge tab 31 is a T-shaped tab having a stem portion 31A with connected cross member 31B having outer wings or portions 31C arranged to fold about foldlines $F_{12}$.

Figure 5:
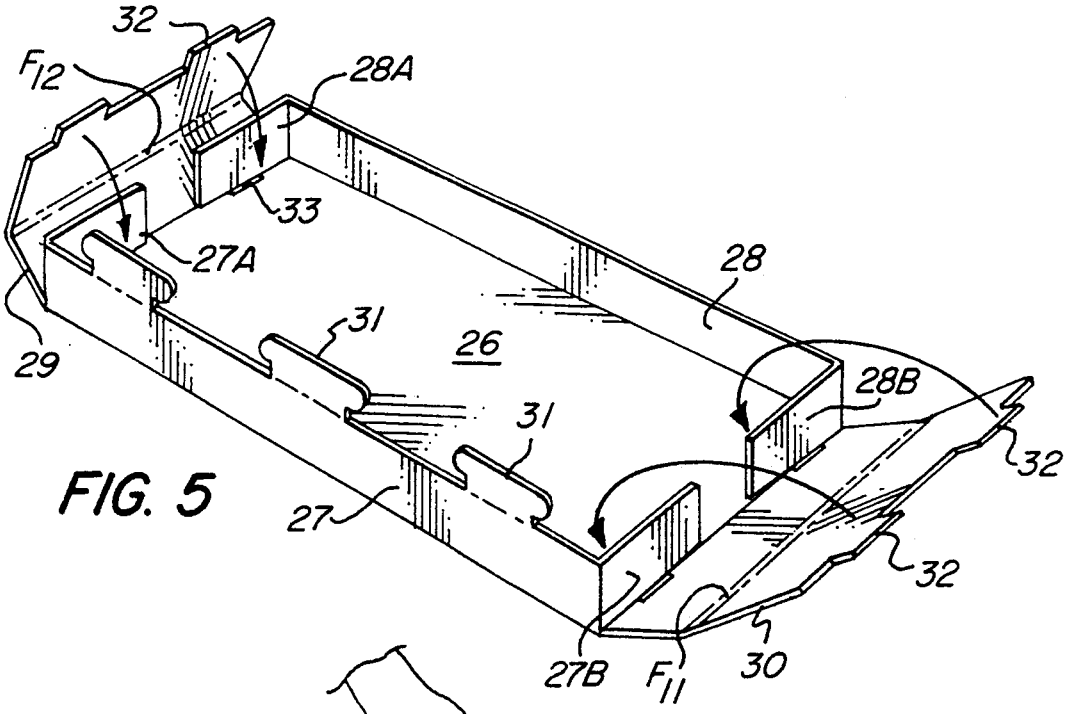
FIG. 5 is a perspective view of the blank of FIG. 2 in a partially folded position to define the box cover.
Figure 6:
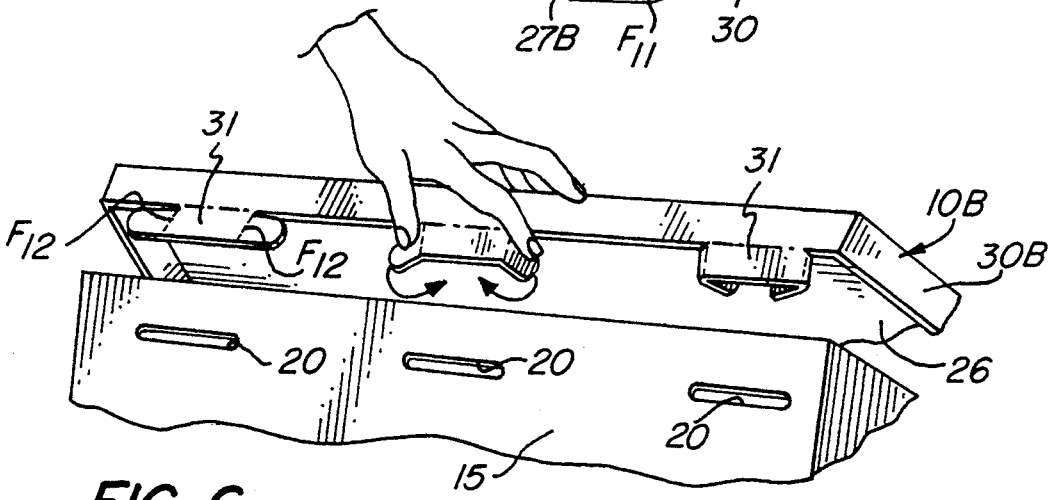
FIG. 6 is a fragmentary perspective view illustrating the interlocking means for detachably hinging the cover to the box body.
Figure 7:
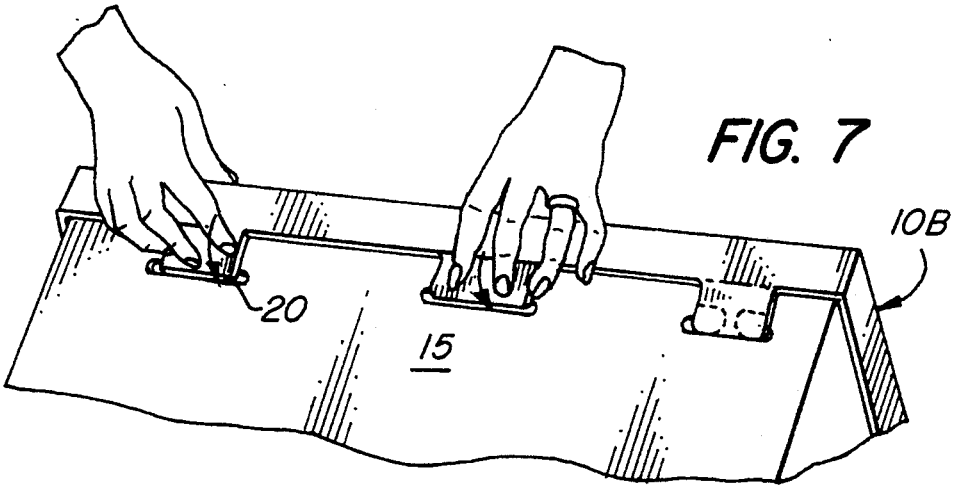
FIG. 7 is a fragmentary perspective view illustrating the detachable hinge connection between the box body and cover.

To assemble the cover 10B, the opposed side edges 27 and 28 are folded relative to the top panel 26 about foldlines $F_8$, $F_9$ as shown in FIG. 5. The respective side corner flaps 27A, 27B and 28A, 28B are folded normal to their corresponding side edges 27, 28. The respective end flaps are then reversely folded about the side corner flaps to form the cover 10B. To secure the cover 10B in its folded position, the free edge of the end flaps are provided with a projecting tab 32 arranged to be received in a locking slot 33.

In accordance with this invention, the cover 10A may be optionally utilized as a free cover or it can be detachably connected to the box body 10A to function as a hinged cover. To hinge the cover 10B to the box body 10A, the user need only to fold the wings 31A of the hinge tabs 31 sufficiently to pass the hinge tabs through their respective hinge slot 20. The wings 31A after insertion through slots 20 are then extended, as seen in FIG. 9, to hingedly secure the cover 10B to the box body 10A. With the cover 10B so hinged to the box body 10A, it will be apparent that the cover 10B can readily swing between open and closed position. The cover 10B hingedly connected as herein described can be readily connected and disconnected at the option of the user.

While the invention has been disclosed with respect to a particular embodiment thereof, it will be understood and appreciated that variations and modifications may be made without departing from the spirit or scope of the invention.

What is claimed is:

1. A knock-down box formed of foldable sheet material comprising:

a preformed blank of foldable sheet material having a first pair of spaced apart transversely extending foldlines, and a second pair of spaced apart foldlines interconnected between said first pair of foldlines, said first and said second pair of foldlines defining a bottom, side and end panels to form an open top box body, a cover for said box body, said cover including a cover blank of foldable sheet material having a first pair of transversely extending cover foldlines extending the width of said cover blank, a second pair of cover foldlines interconnected between said first pair of cover foldlines and extending longitudinally of said cover blank, said first and second pairs of cover foldlines defining a top cover panel and circumscribing side and end edges, one of said side edges of said cover having a plurality of hinging tabs connected thereto, said hinging tab including a stem portion and a connected cross piece, said cross piece being slightly spaced from said one side edge, a plurality of slots formed adjacent an edge of a corresponding one of said side panel of said box body, said slots having a width which is less than the length of said cross piece of said hinging tab, and said cross piece having oppositely disposed wing portions arranged to be folded inwardly toward said stem, whereby each of said hinging tabs is extended through a corresponding slot of said plurality of slots and secured thereto by extending said wing portions.

2. A knock-down box formed from foldable sheet material comprising:

a blank of foldable sheet material having a first pair of spaced apart foldlines extending transversely across the entire width of the blank to define a central portion and opposed end portions, a second pair of spaced apart foldlines extending longitudinally of said blank between said first pair of spaced apart foldlines, said first and second pair of foldlines defining therebetween a bottom panel and opposed side panels, said opposed end portions of said blank having slits extending co-linearly of said second pair of foldlines to define end panels foldable about said first pair of foldlines, said side panels each having opposed side corner panels hingedly connected thereto, each of said side panels and associated opposed side corner panels being foldable about said second pair of foldlines to position said side panels and associated side corner panels normal to said bottom panel, and said end panels being folded about said first pair of foldlines to overlap the corresponding side corner panels adjacent said end panels, means for interlocking said side and opposed end panels in the erected position to define an open top box body, and a cover, said cover formed of a blank of sheet material foldable between a folded and unfolded position, said cover blank having a first pair of spaced apart foldlines extending transversely the width thereof, and a second pair of foldlines extending longitudinally between said first pair of cover foldlines, said first and second pair of foldlines of said cover blank defining a top panel and circumscribing side edges and end flaps of said cover in the folded position of said cover blank, a plurality of locking tabs connected to one of said side edges of said cover, each of said locking tabs having a depending stem portion, and a connected cross piece, said cross piece having oppositely disposed end portions adapted to be capable of being foldable to overlie said stem portion, and said side panel having a complementary hinge slot for receiving one of said locking tab of said cover, said hinge slot having a width slightly greater than the width of said stem portion and less than the length of said cross piece whereby the interlocking of said locking tab with said hinge slot hingedly secures said cover to said box body.

* * * * *